US006137410A

United States Patent [19]

Sepulveda

[11] Patent Number: 6,137,410

[45] Date of Patent: Oct. 24, 2000

[54] BAG WITH SOUND EMITTING DEVICE

[76] Inventor: Jorge Sepulveda, 271 Hough Ave., Bridgeport, Conn. 06608

[21] Appl. No.: 09/461,659

[22] Filed: Dec. 14, 1999

Related U.S. Application Data

[60] Provisional application No. 60/113,369, Dec. 23, 1998.

[51] Int. Cl.[7] ..... G08B 13/14

[52] U.S. Cl. ..... 340/568.7; 340/328; 340/691.1; 340/692

[58] Field of Search ..... 340/691.1, 691.2, 340/568.7, 686.1, 571, 568.1, 692, 384.1, 328; 200/293.1, 61.85, 61.62, 43.17; 116/99; 248/95

[56] References Cited

U.S. PATENT DOCUMENTS

| | | | |
|---|---|---|---|
| 3,609,341 | 9/1971 | Castaldo | 240/6.45 P |
| 3,609,342 | 9/1971 | Wisniewski | 240/6.45 |
| 4,584,571 | 4/1986 | Smit et al. | 340/572 |
| 4,802,071 | 1/1989 | Schuster | 362/154 |
| 4,926,296 | 5/1990 | Blume et al. | 362/156 |
| 5,005,111 | 4/1991 | Teal | 362/156 |

*Primary Examiner*—Jeffery A. Hofsass
*Assistant Examiner*—Phung Nguyen
*Attorney, Agent, or Firm*—Goldstein & Canino

[57] ABSTRACT

A bag with sound emitting device including a bag portion defined by an open upper end and a closed lower end. The open upper end has a pair of handles extending upwardly therefrom in a spaced relationship on opposing sides of the bag. A pair of metal plates are secured to interior surfaces of the handles. One of the metal plates has a pair of contacts extending outwardly therefrom whereby engagement of the metal plate and the pair of contacts together creates a closed circuit and separation of the metal plate from the pair of contacts creates an open circuit. A sound emitting device is secured within an interior of the bag. The sound emitting device has a wire extending outwardly therefrom and coupling with the metal plate having the pair of contacts. The sound emitting device transmits an audible signal upon the separation of the metal plates.

3 Claims, 2 Drawing Sheets

BAG WITH SOUND EMITTING DEVICE

CROSS REFERENCES AND RELATED SUBJECT MATTER

This application relates to subject matter contained in provisional patent application Ser. No. 60/113,369, filed in the United States Patent & Trademark Office on Dec. 23, 1998.

BACKGROUND OF THE INVENTION

The present invention relates to a bag with sound emitting device and more particularly pertains to emitting a noise upon opening of the bag.

Decorative bags have been used at holiday times to carry articles from one location to another. Many of the decorative bags are designed with the spirit of the holiday in mind. It was, at one time, unique for a child to carry one of these bags in order to stand out amongst their peers. The children, at these times, are always seeking new ways to better their friends. This is generally accomplished by wearing a better, or scarier, costume at Halloween. The present invention attempts to provide an accompaniment to a Halloween costume that will aid in the effect of the Halloween spirit.

The use of decorative bags is known in the prior art. More specifically, decorative bags heretofore devised and utilized for the purpose of carrying articles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,926,296 to Blume discloses a bag for festive occasions, such as Halloween, with a power source incorporated therein for illuminating attached light bulbs. U.S. Pat. No. 5,493,274 to Long discloses a bag with an audible alarm incorporated therein, used to protect a golf bag. U.S. Pat. No. Des. 258,205 to Kroll discloses an ornamental design for a Halloween bag. U.S. Pat. No. 5,567,054 to Dalgleish discloses an illuminated bag.

While these devices fulfill their respective, particular objective and requirements, the aforementioned patents do not describe a bag with sound emitting device for emitting a noise upon opening of the bag.

In this respect, the bag with sound emitting device according to the present invention substantially departs from the conventional concepts and designs of the prior art, and in doing so provides an apparatus primarily developed for the purpose of emitting a noise upon opening of the bag.

Therefore, it can be appreciated that there exists a continuing need for new and improved bag with sound emitting device which can be used for emitting a noise upon opening of the bag. In this regard, the present invention substantially fulfills this need.

SUMMARY OF THE INVENTION

In the view of the foregoing disadvantages inherent in the known types of decoative bags now present in the prior art, the present invention provides an improved bag with sound emitting device. As such, the general purpose of the present invention, which will be described subsequently in greater detail, is to provide a new and improved bag with sound emitting device and method which has all the advantages of the prior art and none of the disadvantages.

To attain this, the present invention essentially comprises a bag portion defined by an open upper end and a closed lower end. The open upper end has a pair of inverted U-shaped handles extending upwardly therefrom in a spaced relationship on opposing sides of the bag. The bag portion has an ornamental design printed thereon. A pair of metal plates are secured to interior surfaces of upper horizontal portions of the handles. One of the metal plates has a pair of contacts extending outwardly therefrom whereby engagement of the metal plate and the pair of contacts together creates a closed circuit and separation of the metal plate from the pair of contacts creates an open circuit. A sound emitting device is secured within an interior of the bag. The sound emitting device has a wire extending outwardly therefrom and coupling with the metal plate having the pair of contacts. The sound emitting device transmits an audible signal upon the separation of the metal plates.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bag with sound emitting device which has all the advantages of the prior art decorative bags and none of the disadvantages.

It is another object of the present invention to provide a new and improved bag with sound emitting device which may be easily and efficiently manufactured and marketed.

It is a further object of the present invention to provide a new and improved bag with sound emitting device which is of durable and reliable construction.

An even further object of the present invention is to provide a new and improved bag with sound emitting device which is susceptible of a low cost of manufacture with regard to both materials and labor, and which accordingly is then susceptible of low prices of sale to the consuming public, thereby making such a bag with sound emitting device economically available to the buying public.

Even still another object of the present invention is to provide a new and improved bag with sound emitting device for emitting a noise upon opening of the bag.

Lastly, it is an object of the present invention to provide a new and improved bag with sound emitting device including a bag portion defined by an open upper end and a closed lower end. The open upper end has a pair of handles extending upwardly therefrom in a spaced relationship on opposing sides of the bag. A pair of metal plates are secured to interior surfaces of the handles. One of the metal plates has a pair of contacts extending outwardly therefrom whereby engagement of the metal plate and the pair of contacts together creates a closed circuit and separation of the metal plate from the pair of contacts creates an open circuit. A sound emitting device is secured within an interior of the bag. The sound emitting device has a wire extending outwardly therefrom and coupling with the metal plate having the pair of contacts. The sound emitting device transmits an audible signal upon the separation of the metal plates.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
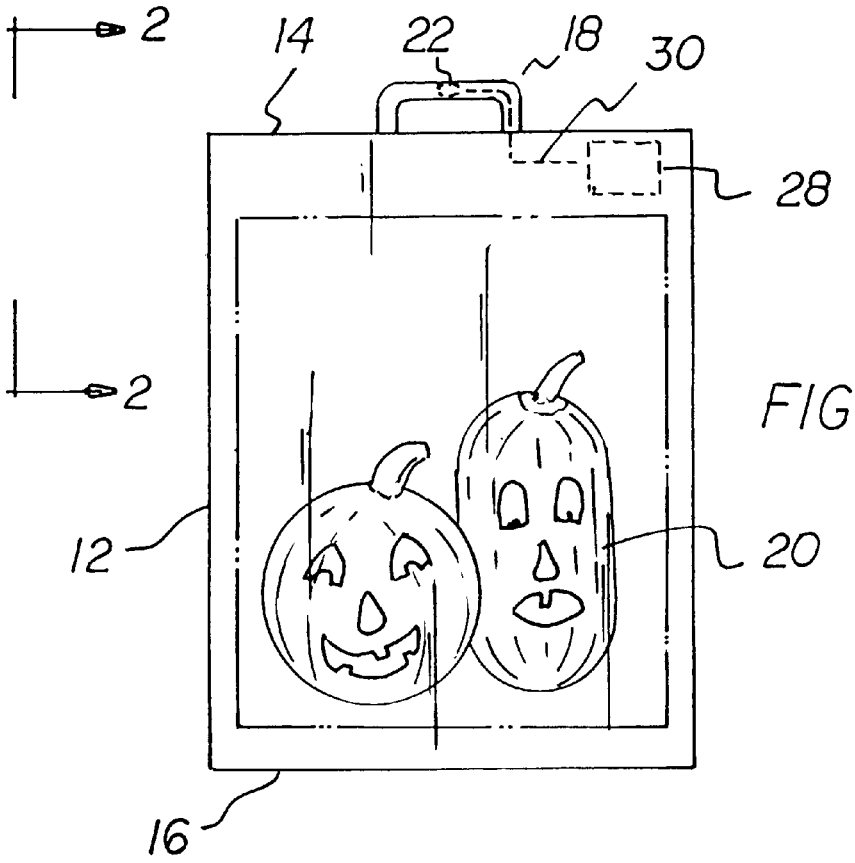
FIG. 1 is a perspective view of the preferred embodiment of the bag with sound emitting device constructed in accordance with the principles of the present invention.
Figure 2:
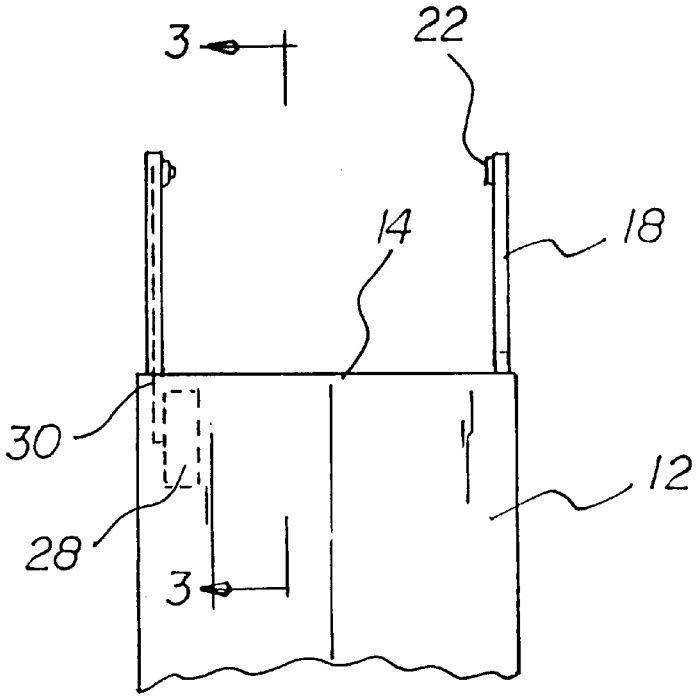
FIG. 2 is a side view of the present invention as taken along line 2—2 of FIG. 1.
Figure 3:
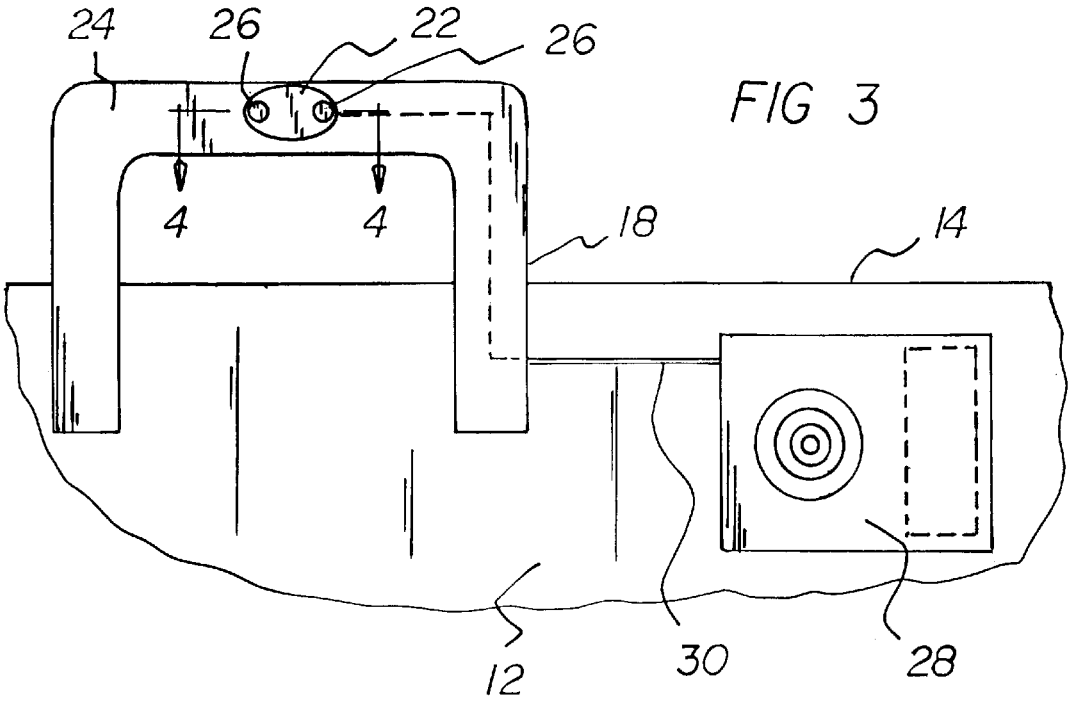
FIG. 3 is a rear view of the carrying handle as taken along line 3—3 of FIG. 2.
Figure 4:
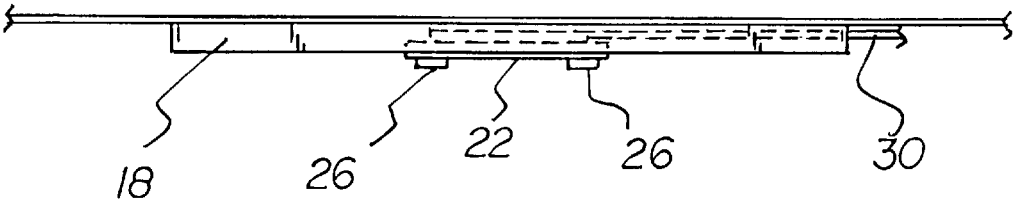
FIG. 4 is a cross-sectional view of the present invention as taken along line 4—4 of FIG. 3.

With reference now to the drawings, and in particular, to FIGS. 1 through 4 thereof, the preferred embodiment of the new and improved bag with sound emitting device embodying the principles and concepts of the present invention and generally designated by the reference number 10 will be described.

Specifically, it will be noted in the various Figures that the device relates to a bag with sound emitting device for emitting a noise upon opening of the bag. In its broadest context, the device consists of a bag portion, a pair of metal plates, and a sound emitting device. Such components are individually configured and correlated with respect to each other so as to attain the desired objective.

The bag portion 12 is defined by an open upper end 14 and a closed lower end 16. The open upper end 14 has a pair of inverted U-shaped handles 18 extending upwardly therefrom in a spaced relationship on opposing sides of the bag portion 12. The bag portion 12 has an ornamental design 20 printed thereon.

The pair of metal plates 22 are secured to interior surfaces of upper horizontal portions 24 of the handles 18. One of the metal plates 22 has a pair of contacts 26 extending outwardly therefrom whereby engagement of the metal plate 22 and the pair of contacts 26 together creates a closed circuit and separation of the metal plate 22 from the pair of contacts 26 creates an open circuit.

The sound emitting device 28 is secured within an interior of the bag portion 12. The sound emitting device 28 has a wire 30 extending outwardly therefrom and coupling with the metal plate 22 having the pair of contacts 26. The sound emitting device 28 transmits an audible signal upon the separation of the metal plates 22. The sound emitting device 28 can be programmed to send audible signals appropriate for the specific occasion. If at Halloween, for example, the audible signal could be "Boo" or "Trick or Treat" or the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A bag with sound emitting device for emitting a noise upon opening of the bag comprising, in combination:

a bag portion defined by an open upper end and a closed lower end, the open upper end having a pair of inverted U-shaped handles extending upwardly therefrom in a spaced relationship on opposing sides of the bag, the bag portion having an ornamental design printed thereon;

a pair of metal plates secured to interior surfaces of upper horizontal portions of the handles, one of the metal plates having a pair of contacts extending outwardly therefrom whereby engagement of the metal plate and the pair of contacts together creates a closed circuit and separation of the metal plate from the pair of contacts creates an open circuit;

a sound emitting device secured within an interior of the bag, the sound emitting device having a wire extending outwardly therefrom and coupling with the metal plate having the pair of contacts, the sound emitting device transmitting an audible signal upon the separation of the metal plates.

2. A bag with sound emitting device for emitting a noise upon opening of the bag comprising, in combination:

a bag portion defined by an open upper end and a closed lower end, the open upper end having a pair of handles extending upwardly therefrom in a spaced relationship on opposing sides of the bag;

a pair of metal plates secured to interior surfaces of the handles, one of the metal plates having a pair of contacts extending outwardly therefrom whereby engagement of the metal plate and the pair of contacts together creates a closed circuit and separation of the metal plate from the pair of contacts creates an open circuit;

a sound emitting device secured within an interior of the bag, the sound emitting device having a wire extending outwardly therefrom and coupling with the metal plate having the pair of contacts, the sound emitting device transmitting an audible signal upon the separation of the metal plates.

3. The bag with sound emitting device as set forth in claim 2 wherein the bag portion has an ornamental design printed thereon.

* * * * *